US005085010A

United States Patent [19]

Grau

[11] Patent Number: 5,085,010

[45] Date of Patent: Feb. 4, 1992

[54] CONTACT ROLL FOR BELT GRINDING MACHINES

[75] Inventor: Rainer Grau, Kronach, Fed. Rep. of Germany

[73] Assignee: Hans Weber Maschinenfabrik GmbH, Kronach, Fed. Rep. of Germany

[21] Appl. No.: 619,129

[22] Filed: Nov. 27, 1990

[30] Foreign Application Priority Data

Nov. 30, 1989 [DE] Fed. Rep. of Germany ... 8914141[U]

[51] Int. Cl.[5] ..... B24B 21/00

[52] U.S. Cl. ..... 51/141; 51/135 R; 29/121.4

[58] Field of Search ..... 51/141, 135 R; 29/121.1, 121.4

[56] References Cited

U.S. PATENT DOCUMENTS

| | | | |
|---|---|---|---|
| 2,162,279 | 6/1939 | Herchenrider | 51/141 |
| 2,725,691 | 12/1955 | Sommer et al. | 51/141 |
| 2,977,725 | 4/1961 | Simendinger | 51/141 |
| 3,553,899 | 1/1971 | Hasegawa | 51/141 |

*Primary Examiner*—M. Rachuba

[57] ABSTRACT

The invention concerns a belt grinding machine contact roll with a steel core and a sleeve surrounding the core. The sleeve includes an intermediate layer of elastically yieldable material, covering at least a portion of the steel core, and closed rings of a hard material surrounding the elastic intermediate layer, which rings are axially arranged next to one another along the core axis and are axially separated from one another by ring grooves.

5 Claims, 1 Drawing Sheet

CONTACT ROLL FOR BELT GRINDING MACHINES

BACKGROUND OF THE INVENTION

The invention concerns a contact roll for belt grinding machines with a steel core and a surrounding sleeve comprising an intermediate layer of elastically yieldable material, at least partially covering the steel core, and a plurality of elements of a hard material arranged on the outer surface of the intermediate layer and intended to engage the grinding belt.

German Gebrauchsmuster 1 953 917 discloses a contact roll in which a steel core is surrounded by a rubber sleeve. This rubber sleeve can be armored or provided with a different profile. The rubber sleeve can also consist of layers of different Shore hardness.

On the other hand there are also known contact rolls which have a steel sleeve. It is entirely common to find with these known rolls from the state of the art that rolls with a relatively soft outer surface possess a high tolerance for irregularities in the work pieces, but they also result in only a low degree of abrasion since the grinding belt is not pressed to the work piece with the required amount of force. Such rolls are not suited to the achievement of high cutting efficiency with metallic work pieces. In contrast to this there have been provided rolls with a hard outer surface, that is for example a steel sleeve, providing a high amount of abrasion per unit of time. These however have only a small tolerance for work pieces with not entirely flat surfaces.

To solve these problems there has already been proposed, in U.S. Pat. No. 2,162,279, a pressure roll of the aforementioned type wherein outer elements of hard material are formed as blocks of hard rubber, cork or steel and are fastened to an intermediate layer of soft rubber surrounding the core, and which elements are moveable independently of one another. These pressure rolls make possible a good tolerance for uneven work pieces. A disadvantage of this solution is, however, that because of the independent moveability of the block type elements on one hand unbalances can appear and on the other hand the elements, when attempting to achieve a high rate of abrasion, can set up large shear forces. These shear forces can in turn lead to a ripping of the elements from the intermediate layer.

SUMMARY OF THE INVENTION

The invention has as its object the provision of a contact roll of the aforementioned type which makes possible on one hand a high abrasion efficiency and on the other hand a good tolerance for uneven work pieces.

This object is solved in accordance with the invention in that elements consisting of hard material are formed as closed rings which surround the elastic intermediate layer and which are arranged axially next to one another and are separated from one another by ring grooves.

In their unloaded condition the rings form a smooth hard cylindrical outer surface interrupted by the grooves, which outer surface makes possible a high amount of abrasion per unit of time and which is therefore especially suited to the grinding of metallic work pieces. On the other hand, in the case of local irregularities or also in the case of a distortion of the work piece the rings because of the elastic intermediate layer deflect in the radial direction, that is they shift radially relative to one another. This makes possible a good work piece unevenness tolerance without degrading the grinding efficiency. This tolerance is also possible without thereby, for example, grinding round or beveling the edges of the work pieces, as is the case with contact rolls having soft sleeve outer surfaces. Also, since the rings are shifted radially in their entirety no unbalance of the contact roll appears.

Advantageously the rings are made of steel. The grooves between the rings serve for cooling the grinding belt. To avoid the transfer of these ring grooves to the ground upper surface of the work piece the width of the grooves and the width of the rings are so dimensioned and the ring segments are in themselves are so formed that along the length of a line extending circumferentially of the contact roll the rings overlap each other several times. In a preferred embodiment the ring grooves are so continuously curved that they cut a middle plane normal to the axis of the roll four times. For example, the edges of the rings can follow the contour of a section line formed by the intersection of each ring with a cylinder whose diameter relative to the diameter of the ring is large and whose axis is arranged perpendicular to the ring axis. With this shaping of the ring the ring segments have in themselves no unbalance even though their edges do not lie in a plane normal to the roll axis. Wobbling of the rings is therefore avoided.

The intermediate layer can be made of natural or synthetic rubber with the Shore hardness of the intermediate layer being one selected from a relatively wide range.

In accordance with a preferred embodiment, the intermediate layer is formed not as a compact cylinder but of a plurality of ribs arranged parallel to one another and spaced from one another. Preferably the ribs extend parallel to the axis of the roll. This construction of the intermediate layer simplifies the mounting of the rings to the intermediate layer.

The contact roll of the invention combines in it the advantages of previous rolls of different types. The contact roll of the invention suits itself to irregularities in the upper surface of the work piece, making possible therefore a related tolerance for such irregularities. Tolerance changes due to work pieces of different hardness are compensated for without adjustment of the roll.

Because of the smooth hard outer surface of the contact roll injuries to the upper surface of the work piece (beyond the area to be ground) are avoided. Further, the danger of damage to the grinding belt by sharp or upstanding work piece edges are reduced since the grinding belt lies against the hard even outer surface of the involved ring and thereby is well backed up. Sharp or upstanding work piece edges therefore cannot penetrate the grinding belt. While maintaining the above-described advantages, a high material removal is achieved since the grinding granules lie against a steel sleeve and are not pressed, as in the case of a rubber roll, rearwardly into the rubber sleeve. The heating of the grinding material is lower so that it is also spoiled by heat to a lesser degree. Also the work piece edges are not unintentionally ground round or beveled.

The steel rings can moreover be coated on their outer circumferential surfaces, for example with a rubber layer.

BRIEF DESCRIPTION OF THE DRAWINGS

The following description explains the invention in connection with the accompanying drawings by way of exemplary embodiments. The drawings are.

DESCRIPTION OF THE PREFERRED EMBODIMENTS

Figure 1:
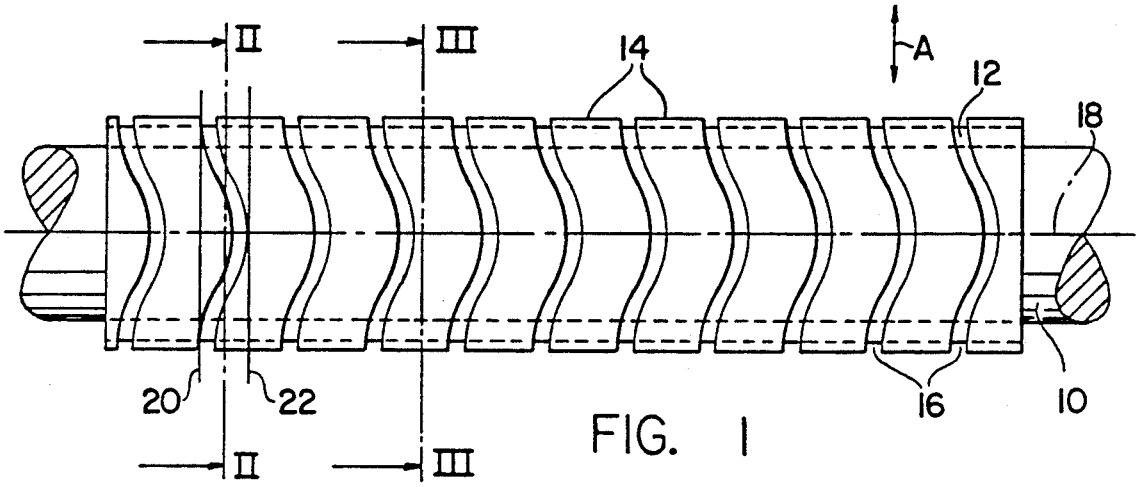
FIG. 1—A side view of a contact roll embodying the invention.

The contact roll for a band grinding machine illustrated in FIG. 1 comprises a shaft or a core 10 surrounded by an intermediate layer 12 or segments made of rubber or similar elastic material. This intermediate material is in turn surrounded by a plurality of ring segments 14 arranged axially next to one another and separated axially from one another by ring grooves 16. The ring segments 14 preferably are made of steel. Their circumferential or outer surfaces are cylindrical and are aligned with one another to form a cylindrical sleeve surface interrupted by the ring grooves 16.

Because of the arrangement of the ring segments 14 on the elastic intermediate layer 12 the ring segments can be shifted in the direction of the double arrow A of FIG. 1 in the radial direction relative to one another.

The axially forcing edges of the ring segments 14 and of the grooves remaining between them, which grooves serve for the cooling of the grinding belt, are of such a continuously curved and sinuous shape that they are entirely symmetrical with respect to the rotational axis 18 of the contact roll. This can especially be seen from FIG. 2. The section plane of FIG. 2 runs exactly through the axial middle of a groove 16, that is it is located midway between the two planes 20 and 22 normal to the roll axis and bordering the axial limits of the groove. Each point of mass on the circumference of a ring segment has associated with it an identical point of mass located diametrically opposite from it, so that the ring segments 14 are entirely balanced. They do not wobble around the axis of the contact roll.

Figure 2:
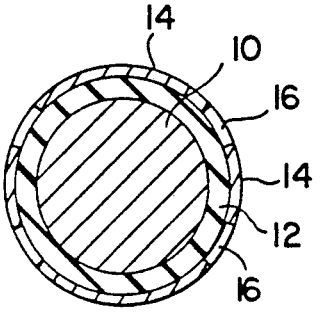
FIG. 2—A section perpendicular to the axis of the roll taken along the line II—II of FIG. 1, FIG. 3—A section normal to the axis of the roll taken along the line III—III of FIG. 1, FIG. 4—A section taken through the contact roll of FIG. 1 and containing the axis of the roll, and FIG. 5—A section corresponding to that of FIG. 3 taken through an alternate embodiment of the invention.
Figure 3:
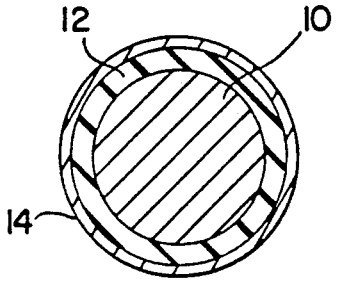

It will be further recognized from FIG. 2 that the groove cuts the middle plane, that is the section plane of FIG. 2, four times throughout one revolution around the groove. The ring segments bordering the groove overlap one another in the circumferential direction, as is represented by the different cross hatchings in FIG. 2. This avoids the forming of images of the grooves 16 on the work surface of the work piece during the grinding process.

Figure 5:
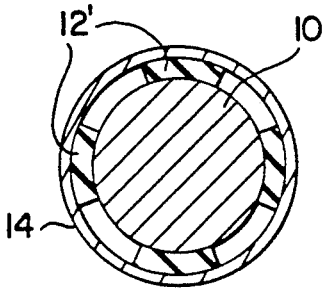
Figure 4:
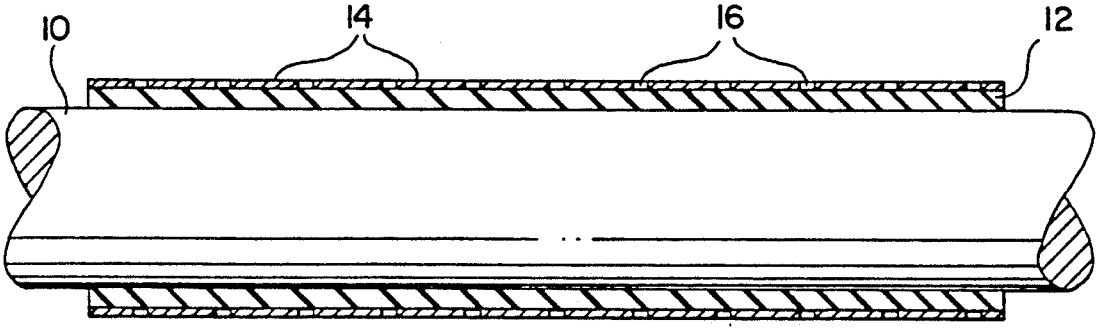

FIG. 5 illustrates an alternate embodiment of the contact roll of the invention in which the intermediate layer is not made of a closed cylindrical layer but instead is formed of four ribs 12' which are arranged on the core 10 parallel to its axis and at equal spaces from one another. The material of the ribs 12' corresponds to the material of the intermediate layer 12 in the embodiment of FIGS. 1 to 4. All other elements of the contact roll of FIG. 5 agree with the corresponding parts of the embodiment according to FIGS. 1 to 4. The solution represented by FIG. 5 has the advantage that the rings or ring segments 14 can be more easily assembled.

I claim:

1. A contact roll for a belt grinding machine with a steel core and a sleeve surrounding said core comprising an intermediate layer covering at least a portion of the steel core and made of an elastically yieldable material and a plurality of outer elements of a hard material arranged on the outer surface of the intermediate layer and intended for engagement with the grinding belt, characterized in that the elements made of hard material are formed as closed rings which surround the elastic intermediate layer and which are separated axially from one another by ring grooves extending continuously around said sleeve and defined by axially facing edges of neighboring ones of said rings, said axially facing edges of said rings being so shaped and the widths of said grooves and the widths of said rings being so dimensioned that neighboring ones of said rings overlap one another several times in the circumferential direction of the contact roll.

2. A contact roll according to claim 1 further characterized in that the rings are made of steel.

3. A contact roll according to claim 1 further characterized in that said edges of said rings are so continuously and sinuously curved and the spacing between two neighboring rings is so chosen that the ring groove running between neighboring rings cuts a middle plane normal to the axis of the roll four times.

4. A contact roll according to claim 1 further characterized in that the intermediate layer is made of a plurality of ribs arranged parallel to one another on the core and equally spaced from one another.

5. A contact roll according to claim 4 further characterized in that the ribs are arranged parallel to the axis of the core.

* * * * *